US007224128B2

(12) United States Patent
Hsu

(10) Patent No.: US 7,224,128 B2
(45) Date of Patent: May 29, 2007

(54) DEVICE FOR DRIVING LIGHT EMITTING DIODE STRINGS

(75) Inventor: Horng-Bin Hsu, Taipei County (TW)

(73) Assignee: AU Optronics Corp., Hsin-Chu (TW)

( * ) Notice: Subject to any disclaimer, the term of this patent is extended or adjusted under 35 U.S.C. 154(b) by 70 days.

(21) Appl. No.: 11/085,567

(22) Filed: Mar. 22, 2005

(65) Prior Publication Data

US 2006/0022607 A1 Feb. 2, 2006

(30) Foreign Application Priority Data

Jul. 30, 2004 (TW) ..... 93123030 A

(51) Int. Cl.
*H05B 37/00* (2006.01)

(52) U.S. Cl. ..... 315/185 R; 315/169.3; 315/307

(58) Field of Classification Search ..... 315/169.3, 315/224, 185 R, 307
See application file for complete search history.

(56) References Cited

U.S. PATENT DOCUMENTS 7,042,164 B2 * 5/2006 Yazawa ..... 315/169.3
2006/0001381 A1 * 1/2006 Robinson et al. ..... 315/185 R

* cited by examiner

*Primary Examiner*—David Vu
(74) *Attorney, Agent, or Firm*—Bacon & Thomas, PLLC

(57) ABSTRACT

A device for driving light emitting diode (LED) string, including a DC(direct current)-to-DC converter, a LED string, a switch and a feedback circuit. The DC-to-DC converter includes a first DC-to-DC converter end for outputting a DC voltage according to a feedback signal. The LED string is coupled to the first DC-to-DC converter end. The switch is coupled to the LED string. When the switch is turned on, the LED string is driven by the DC voltage, and then a DC current is flowed through the LED string. The feedback circuit outputs the feedback signal according to the DC current. When the switch is turned on, the LED string is quickly turned on to a predetermined brightness. When the switch is turned off, the LED string is quickly turned off.

41 Claims, 10 Drawing Sheets

DEVICE FOR DRIVING LIGHT EMITTING DIODE STRINGS

This application claims the benefit of Taiwan application Serial No. 093123030, filed Jul. 30, 2004, the subject matter of which is incorporated herein by reference.

BACKGROUND OF THE INVENTION

1. Field of the Invention

The invention relates in general to a device for driving a light emitting diode string, and more particularly to a device for driving a light emitting diode string for applying in a backlight module.

2. Description of the Related Art

Conventionally, backlight modules are provided as the light sources for LCD panels, where the light can be produced by LEDs. LEDs are solid state semiconductor light sources, and have the following advantages: extra-long lifetime, low power, low operating voltage, low operating temperature, and quick response time. These are advantages that can not be matched by cold cathode fluoresce lamps (CCFL), and are the reasons to the wide use of LEDs in various illuminations and small scale backlight modules of cellular phones. It is becoming apparent that LEDs will gradually replace CCFLs in many applications.

FIG. 1 (Prior Art) shows circuit diagram of a conventional driving device for LEDs. The driving device 100 includes a DC voltage source 102, a DC chopper 104, a filtering device 106, and a LED string 108. The DC chopper 104 is used for controlling the electrical connection between DC voltage source 102 and LED string 108, and the LED string 108 is controlled to turn on or turn off accordingly, i.e. to light up or shut off. Since filtering circuit 106 has an inductance, the waveform of current I of LED string 108 forms triangular waves, as shown in FIG. 1B. As a result, the LED string 108 can not operate with a fixed conducting current. Even if a voltage-stabilizing capacitor is connected to the LED string in parallel to stabilize current I, the problem of long capacitor charging and discharging time prevents LED string 108 from able to be quickly turned on or off.

SUMMARY OF THE INVENTION

It is therefore an object of the invention to provide a device for driving LED strings capable of operating with fixed conducting currents and quickly turning on or off the LED string.

The invention achieves the above-identified object by providing a driving device for LED strings, including a DC-to-DC converter, a LED string, a switch and a feedback circuit. DC-to-DC converter has a first DC-to-DC converter end, for outputting a DC voltage according to a feedback signal outputted by the feedback circuit. The LED string is coupled to the first DC-to-DC converter end. The switch and the LED string are serially connected. When the switch is turned on, the DC voltage drives the LED string, and the DC current flows through the LED string. The feedback circuit outputs the feedback signal according to the DC current. When the switch is turned on, the LED string is quickly turned on to reach a predetermined brightness level, and when the switch is turned off, the LED string is quickly turned off.

Other objects, features, and advantages of the invention will become apparent from the following detailed description of the preferred but non-limiting embodiments. The following description is made with reference to the accompanying drawings.

DETAILED DESCRIPTION OF THE INVENTION

First Embodiment

Figure 1A:
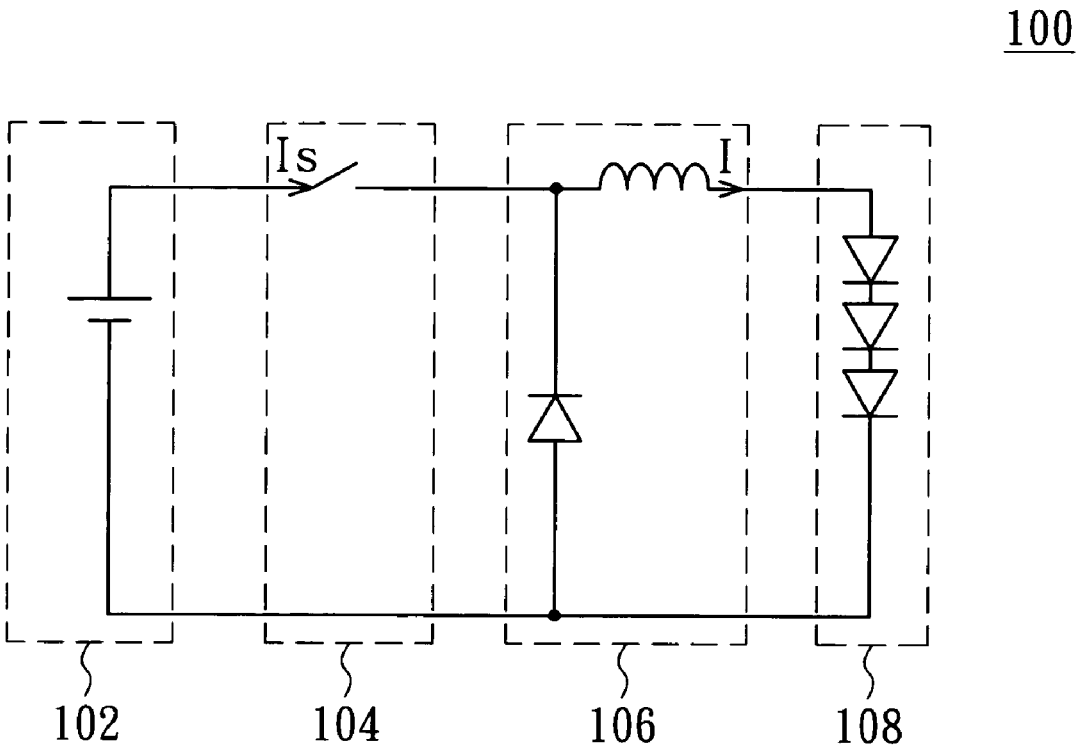
FIG. 1A(PRIOR ART)
FIG. 1A–1B (Prior Art) shows a circuit diagram of a conventional driving device for LED strings and its related driving waveform.
Figure 1B:
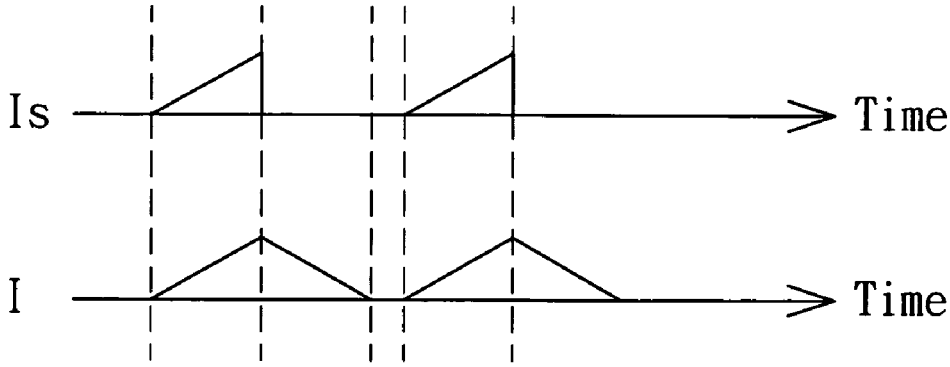
FIG. 1B(PRIOR ART)
Figure 2:
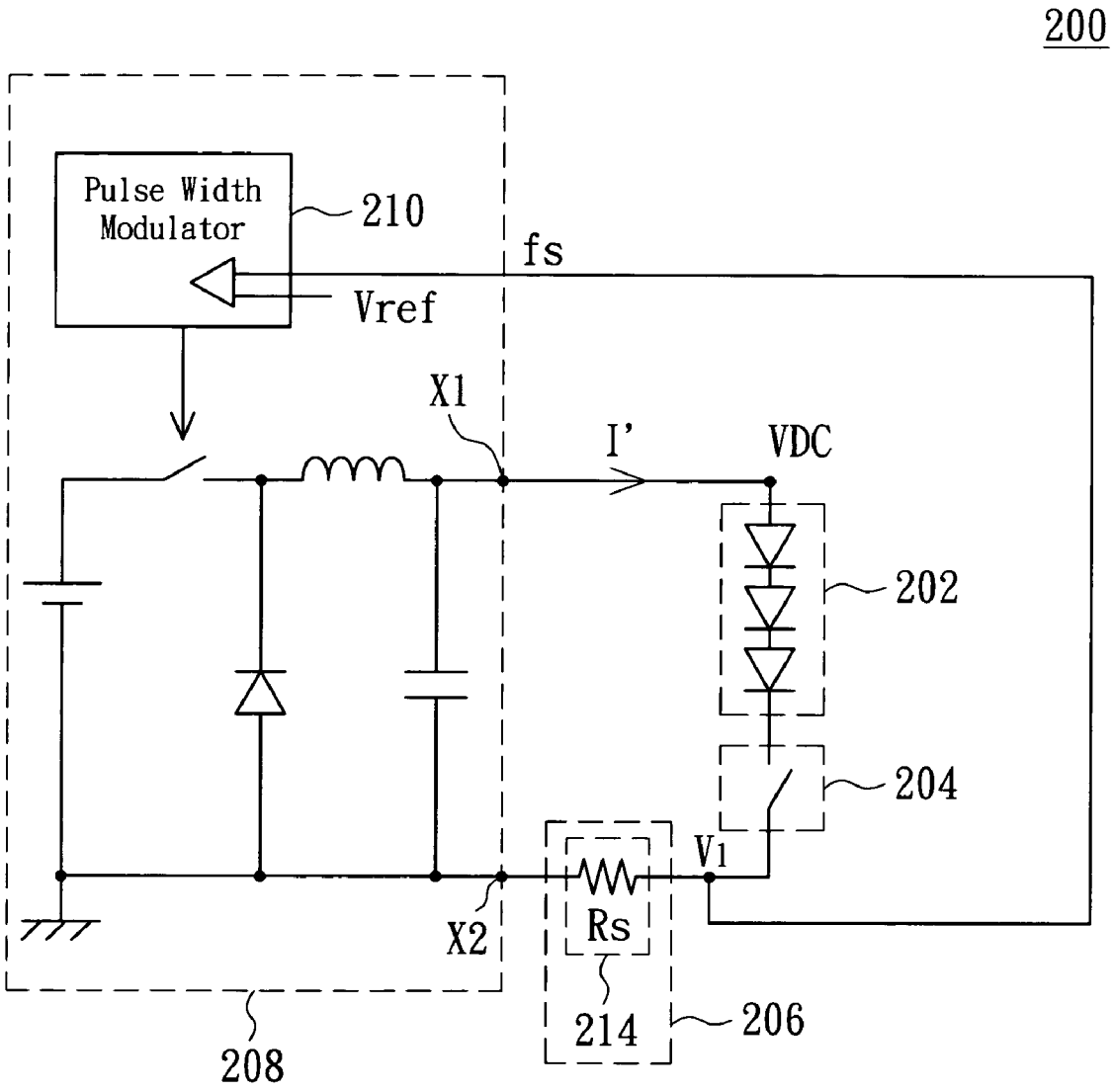
FIG. 2 shows a circuit diagram of a driving device for LED strings according to a first embodiment of the invention.

FIG. 2 shows a circuit diagram of a driving device 200 for LED strings according to a first embodiment of the invention. Driving device 200 can be applied in backlight modules of LCD panels, and comprises a DC-to-DC converter 208, a LED string 202, a switch 204, and a feedback circuit 206. For illustration, DC-to-DC converter 208 in this embodiment is supposed as a buck converter, and the LED string 202 is provided as the light source required to light a LCD panel.

DC-to-DC converter 208 has a first DC-to-DC converter end X1 and a second DC-to-DC converter end X2. The second DC-to-DC converter end X2 is coupled to a fixed voltage, such as the fixed voltage being a ground voltage. DC-to-DC converter 208 outputs a DC voltage VDC from the first DC-to-DC converter end X1 according to a feedback signal fs. LED string 202 is coupled to the first DC-to-DC converter end X1. Switch 204 and LED string 202 are serially connected. When switch 204 is turned on, LED string 202 is driven by the DC voltage VDC, and a DC current I' flows through LED string 202, causing the LEDs to light up. Feedback circuit 206 then outputs the feedback signal fs according to the DC current I'.

To achieve the object of quickly turning on or turning off LED string 202, i.e. to quickly light up or shut off LED string 202, switch 204 and LED string 202 are connected in series in this embodiment. That is, when switch 204 is turned on, a fixed conducting current flows through LED string 202, and LED string 202 is quickly lit up to reach a predetermined brightness level; when switch 202 is turned off, the fixed conducting current immediately stops flowing through LED string 202, and LED string 202 is quickly shut off. Thus, the problem of slow response time of LED string 202 caused by the slow change of current I' due to energy storing elements in DC-to-DC converter 208 can be prevented. Also, through the use of switch 204 to control the LED string 202 to be quickly turned on or turned off, the value of the energy storing elements of DC converter 208, such as the inductances and capacitances, can be increased, and thereby causing the current I' outputted to be more stable.

DC-to-DC converter 208 further includes a pulse width modulator 210. The feedback circuit 206 generates feedback signal fs according to DC current I', and the pulse width modulator 210 adjusts the output signal according to feedback signal fs so that DC-to-DC converter 208 can output stable DC voltage VDC. Furthermore, feedback circuit 206 includes a current-voltage converter 214. Current-voltage converter 214 has a first end and a second end. The first end of the current-voltage converter 214 is coupled to the switch 204, while the second end of the current-voltage converter 214 is coupled to the second DC-to-DC converter end X2 of DC-to-DC converter 208. Current-voltage converter 214 is for example a resistor Rs. When switch 204 is turned on to allow conduction, according to the DC current I' that flowed through, current-voltage converter 214 generates a first reference voltage V1 to be used as the feedback signal fs. The magnitude of current I' can be controlled by DC-to-DC converter 208 according to feedback signal fs so that the light output of LED string is maintained.

In addition, in another embodiment derived from this embodiment, when each of multiple LED strings is being driven by a corresponding DC-to-DC converter, the magnitude of current I' flowing through each LED string can be individually controlled. And the magnitude of I' is being individually controlled by the feedback circuit associated with each LED string, so the currents flowing through LEDs of different characteristics which are disposed on different LED strings can still have the same magnitude so that same brightness can be produced by different LED strings, allowing the brightness of backlight module formed by multiple LED strings to be more even.

Second Embodiment

Figure 3:
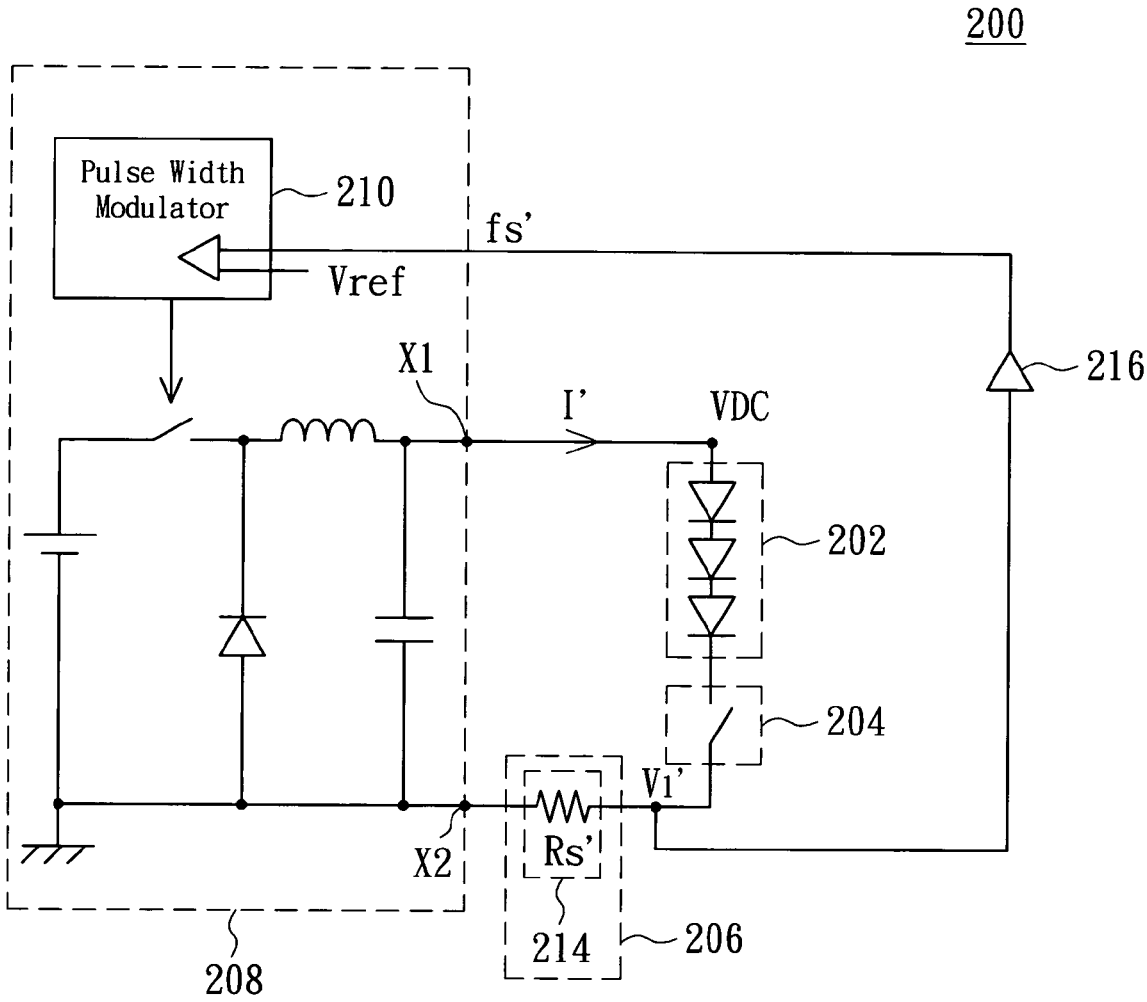
FIG. 3 shows a circuit diagram of a driving device for LED strings according to a second embodiment of the invention.

Referring to FIG. 3, a circuit diagram of a driving device for LED strings according to a second embodiment of the invention is shown. The difference between this embodiment and the first embodiment is that the driving device 200 further includes an amplifier 216, which is connected to the first end of the current-voltage converter 214 and the pulse width modulator 210. In addition, the resistor Rs' can have a lower resistance than resistor Rs of the first embodiment in order to reduce power consumption in Rs'. After a smaller reference voltage V1' is being amplified by amplifier 216, the feedback signal fs' is generated and outputted to pulse width modulator 210. By doing so, the driving device 200 of this embodiment can still produce a feedback signal fs' of voltage magnitude close to that of feedback signal fs of the first embodiment, in order that DC-to-DC converter 208 can still control the magnitude of DC current I' according to feedback signal fs'. Hence, the light output of LED string can remain constant. In addition, in another embodiment derived from this embodiment, when each of multiple LED strings is being driven by a corresponding DC-to-DC converter, the magnitude of current I' flowing through each LED string can be individually controlled. And the magnitude of I' is being individually controlled by the feedback circuit associated with each LED string, so the currents flowing through LEDs of different characteristics, which are disposed on different LED strings, can still have the same magnitude so that same brightness can be produced by different LED strings, allowing the brightness of backlight module to be more even.

Third Embodiment

Figure 4:
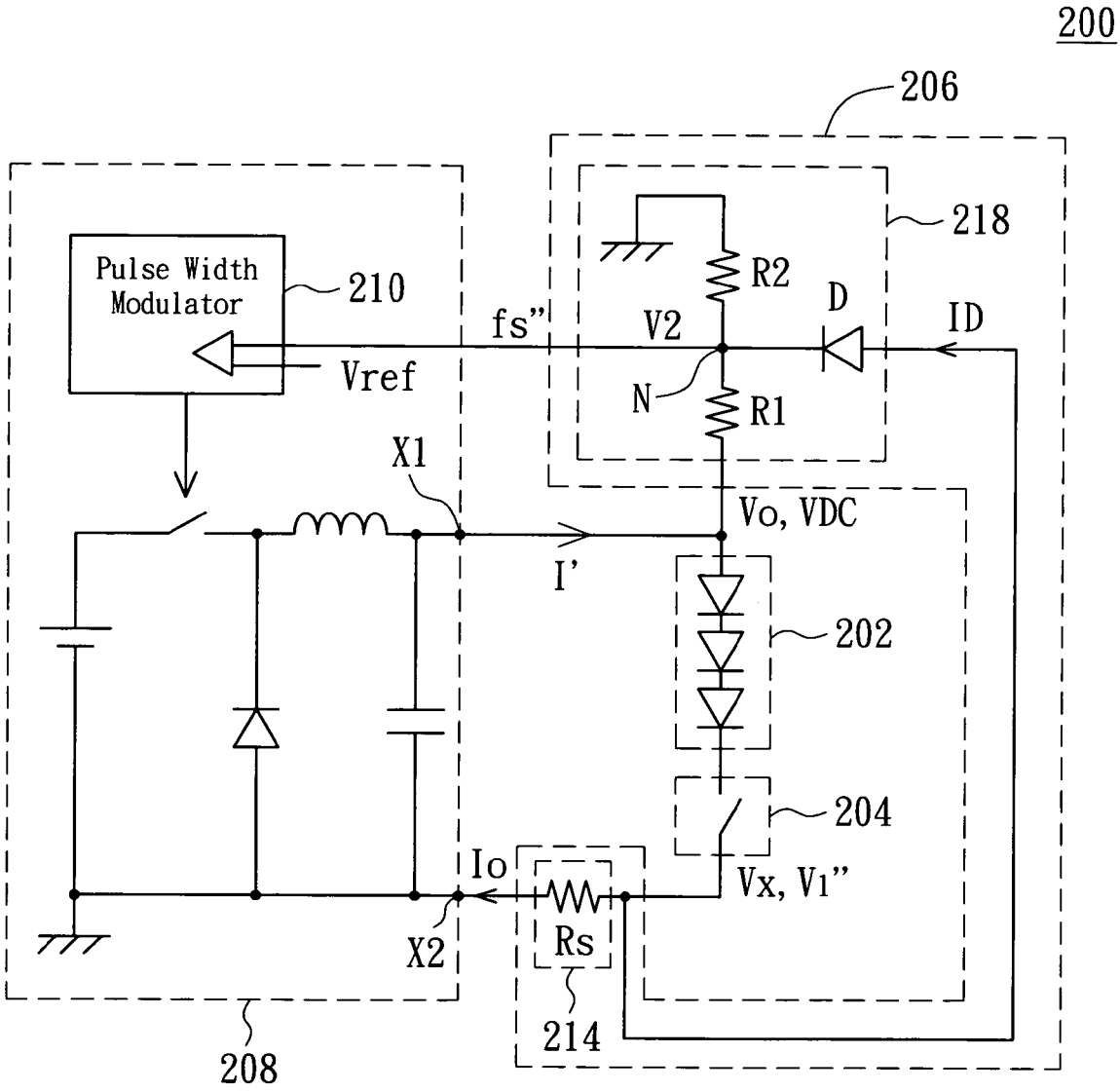
FIG. 4 shows a circuit diagram of a driving device for LED strings according to a third embodiment of the invention.
Figure 5:
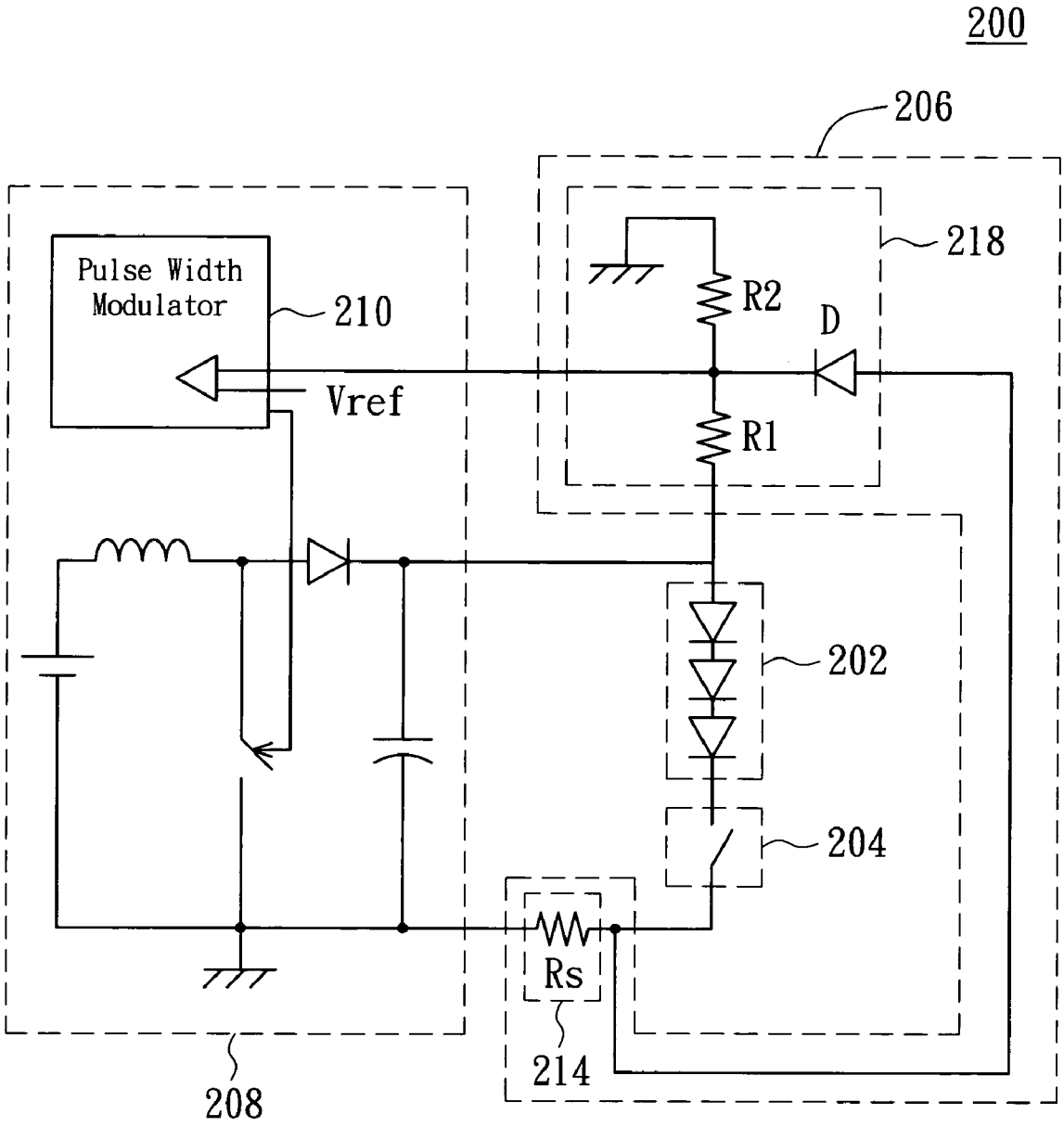
FIG. 5 shows a circuit diagram of a driving device for LED strings having a Boost converter.
Figure 6:
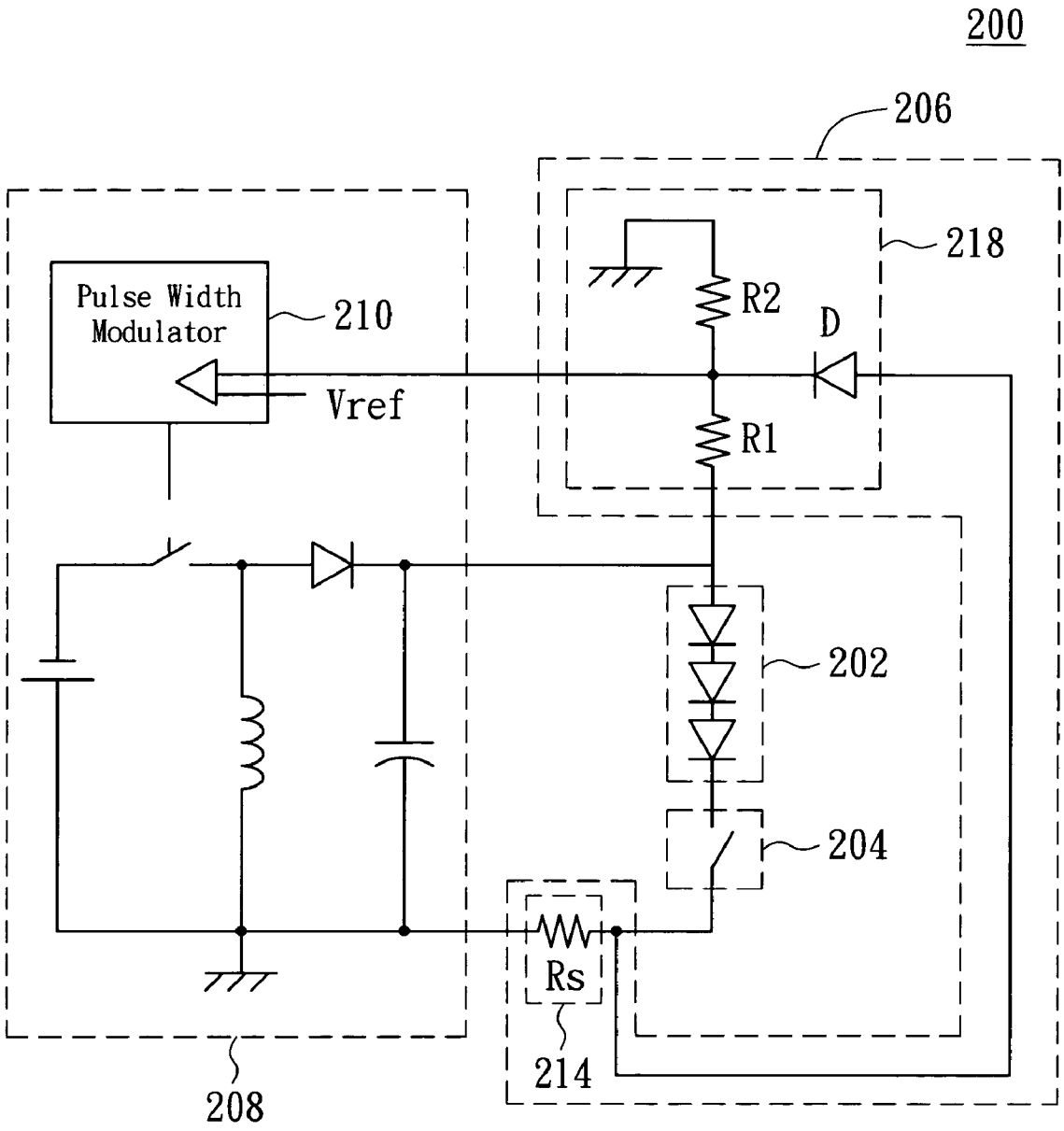
FIG. 6 shows a circuit diagram of a driving device for LED strings having a Buck-Boost converter.
Figure 7:
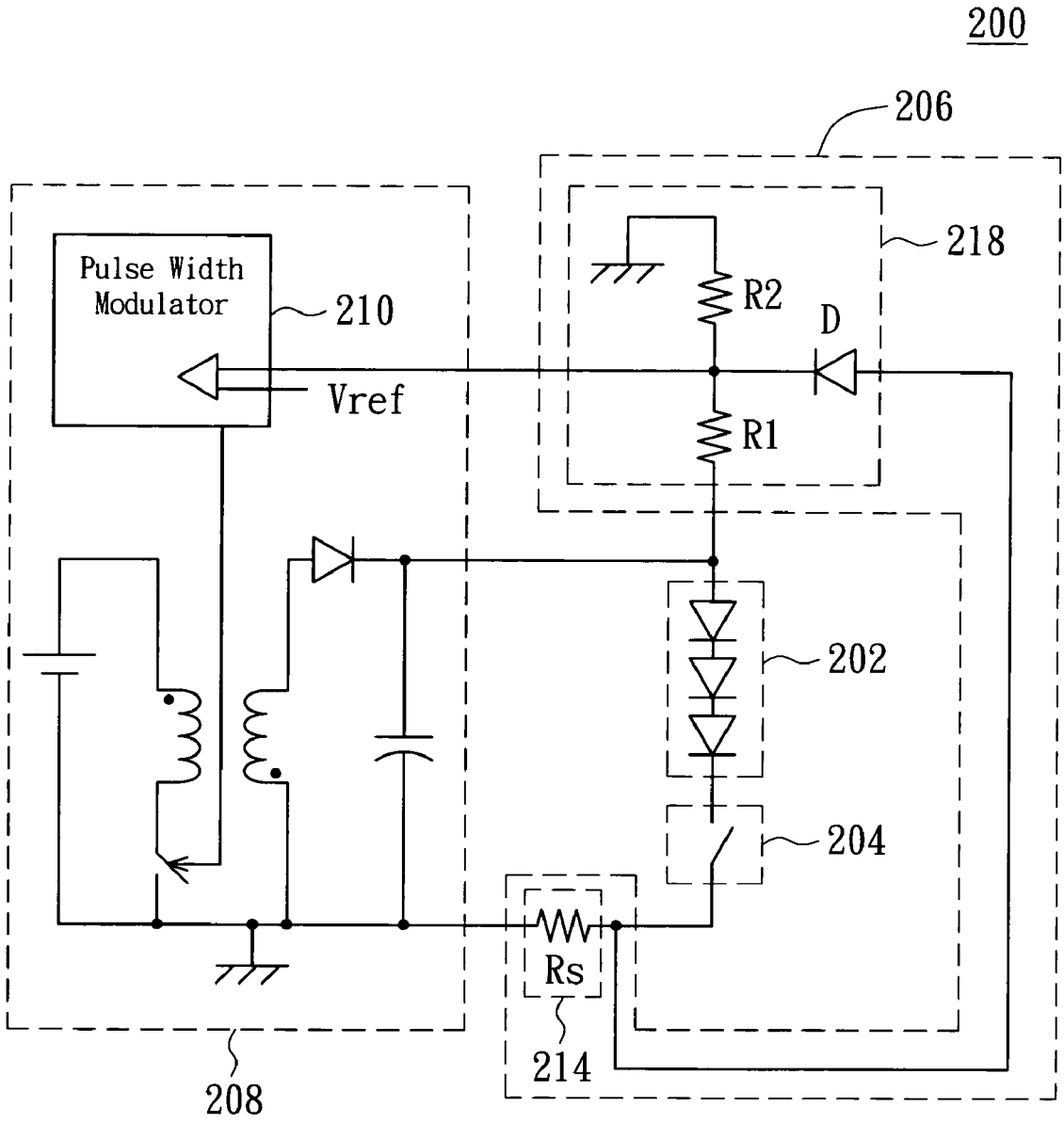
FIG. 7 shows a circuit diagram of a driving device for LED strings having a Flyback converter.
Figure 8:
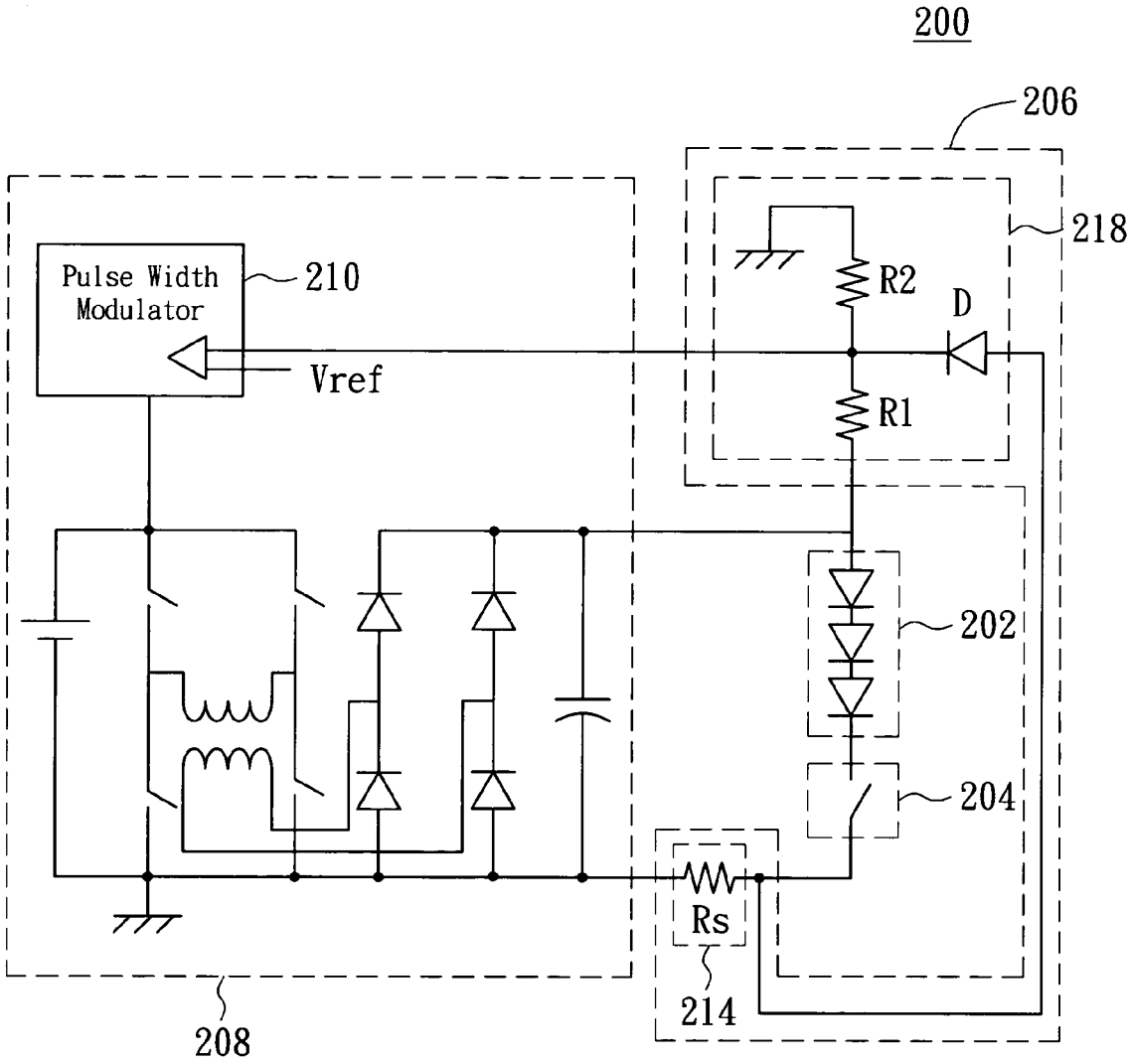
FIG. 8 shows a circuit diagram of a driving device for LED strings having a Full-Bridge converter.

FIG. 4 shows a circuit diagram of a driving device for LED strings according to a third embodiment of the invention. In the first and second embodiments, when the switch 204 is turned off, DC current I' will not be generated, thus, feedback circuit 206 can not output feedback signal fs' according to the first reference voltage V1", and without knowing the value of current DC voltage VDC, the DC-to-DC converter 208 can not effectively control DC voltage VDC, which may cause level shifting of DC voltage VDC. Hence, LED string 202 can not be quickly lit up to reach the predetermined brightness level the next time being turned on.

Therefore, this embodiment is different from the first and second embodiments in that the feedback circuit 206 further includes a voltage feedback circuit 218. When switch 204 is turned off, voltage feedback circuit 218 outputs a second reference voltage V2 according to DC voltage VDC to be used as the feedback signal Fs".

Moreover, voltage feedback circuit 218 includes a first impedance element R1, a second impedance element R2 and a diode D. The first impedance element R1 has a first end of the first impedance element and a second end of the first impedance element. The first end of the first impedance element is coupled to DC voltage VDC, and the second end of the first impedance element is coupled to a node N. Node N is in turn coupled to the pulse width modulator 210. R2 also has two ends. The first end of the second impedance element R2 is coupled to node N, and the second end of the second impedance element R2 is coupled to the fixed voltage. The negative end of the diode D is coupled to node N, while the positive end of the diode D is coupled to the first end of current-voltage converter 214. The voltage at node N is taken as the second reference voltage V2. In other words, when switch 204 is turned off, diode D is reverse-biased, and the second reference voltage V2 at this time is determined by the first and second impedance elements. At this time, feedback circuit 206 is to use second reference voltage V2 as the feedback signal fs" to be fed back to the pulse width modulator 210. Therefore, when LED string 202 is turned off due to switch 204 being turned off, DC-to-DC converter 208 can maintain the magnitude of DC voltage VDC according to the second reference voltage V2 being fed back. Thus, when switch 204 is subsequently turned on, the problem of level shifting in VDC voltage level due to the switch being turned off can be prevented. Hence, the next time when LED string 202 is lit up again, a current I' close to the predetermined magnitude of DC current will quickly flow through LED string 202, thereby allowing LED string 202 to quickly light up to the predetermined brightness level.

Similarly, when switch 204 is turned on, most of DC current I' flows into current-voltage converter 214, so that current-voltage converter 214 can generate a reference voltage V1" according to DC current I'. In this embodiment, diode D is forward-biased and the second reference voltage is determined by the first reference voltage V1". Feedback circuit 206 at this time uses second reference voltage V2 as feedback signal Fs". That is, when switch 204 is turned on, first reference voltage V1" must be greater than the voltage at node N to make sure that diode D is forward-biased and second reference voltage V2 can be determined by first reference voltage V1".

Figure 9:
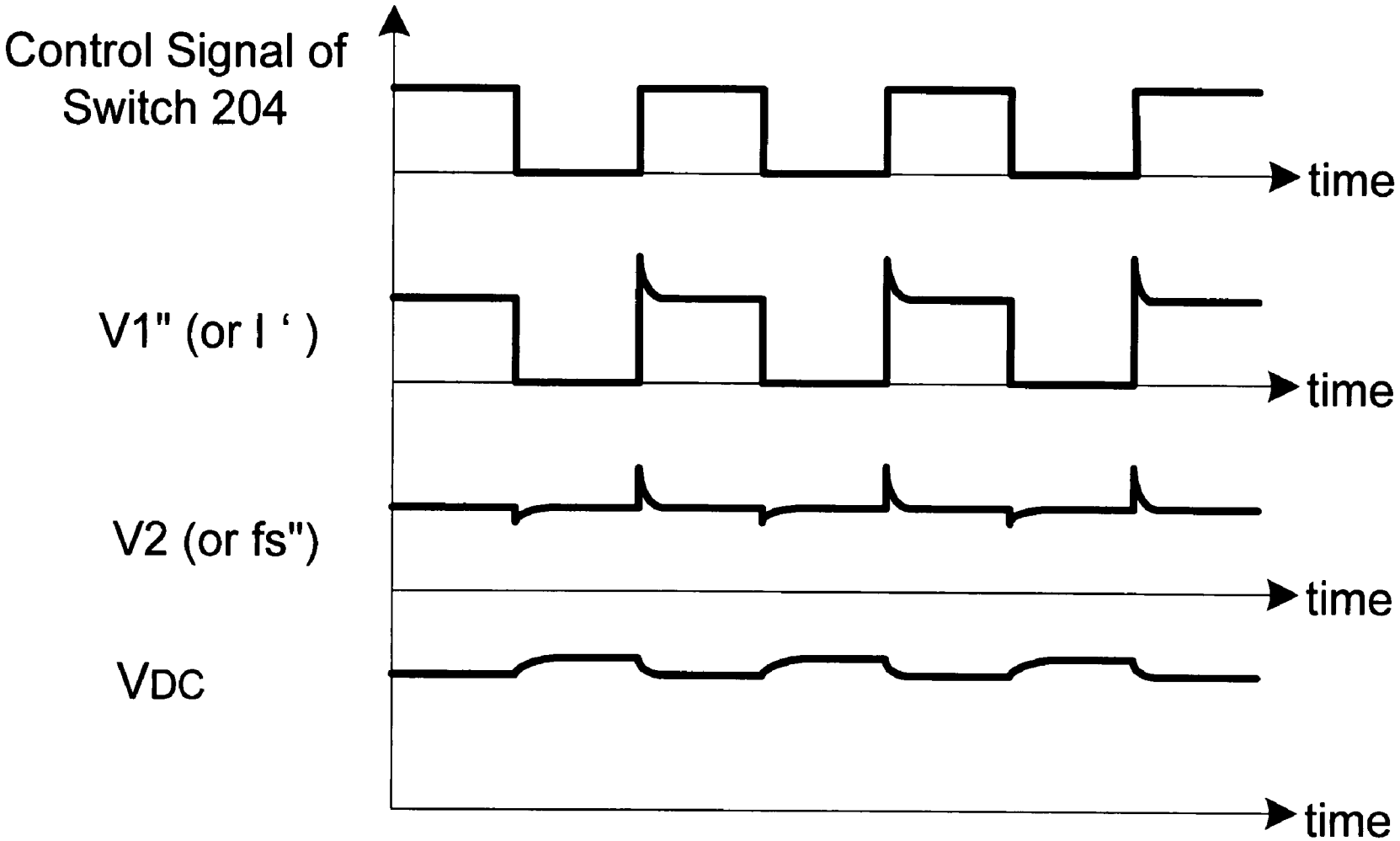
FIG. 9 shows relative waveforms of the control signal of switch 204, the first reference voltage V1", the second reference voltage V2, and the output voltage Vo from the DC-to-DC converter 208.

Next, how the second reference voltage V2 is determined through the first reference voltage V1" turning on diode D is further discussed. Referring to FIG. 9, in which the relative waveforms of the control signal of switch 204, the first reference voltage V1", the second reference voltage V2, and the DC voltage VDC from the DC-to-DC converter 208 are shown. In the figure, the effects from the forward-biased voltage drop across the diode D is ignored. When switch 204 is turned off, i.e. the control signal of switch 204 is low, the voltage V2 at node N, determined from the voltage drop across the first and the second impedance elements R1 and R2 via VDC, is at a lower voltage level than that of Vref. Vref is a reference signal of the comparator in the pulse width modulator 210, and is being compared with feedback signal Fs". Thus, through the control of the pulse width modulator 210, the output voltage Vo is increased so as to allow voltage V2 to be substantially equal to the reference voltage Vref. The voltage bias at node N is higher than the voltage at the positive terminal of the diode D; thus, the diode is reverse-biased. Therefore, the first reference voltage V1" does not contribute to the voltage V2 at node N. When switch 204 is turned on, the instant voltage of VDC (V(on)) is larger than the VDC (Vo(off)) before the switching. Thus, the DC current I' is also higher than a predetermined value and V1" higher than the reference voltage Vref. Consequently, V1" is higher than V2, and the diode D is now forward-biased. Thus, the voltage V2 at node N is determined by V1". Then, through the pulse width modulator 210, the output voltage Vo is reduced such that the DC current I' decreases the predetermined value, so that V2 can be substantially equal to Vref. Thus, in design considerations, since the voltage V2 is derived from the voltage across R1 and R2 via VDC when the switch 204 is turned off, the ratio of the first impedance element to the second impedance element R1/R2 is arranged such that when the switch 204 is turned on, V1" is always higher than the voltage V2.

The feedback circuit 206 as described in the third embodiment can also adopt the method of the second embodiment, where an amplifier 216 can be connected between the first end of current-voltage converter 214 and the positive end of the diode D so that Rs can be selected a smaller resistance value in order to reduce the power consumed by Rs.

Fourth Embodiment

Figure 10:
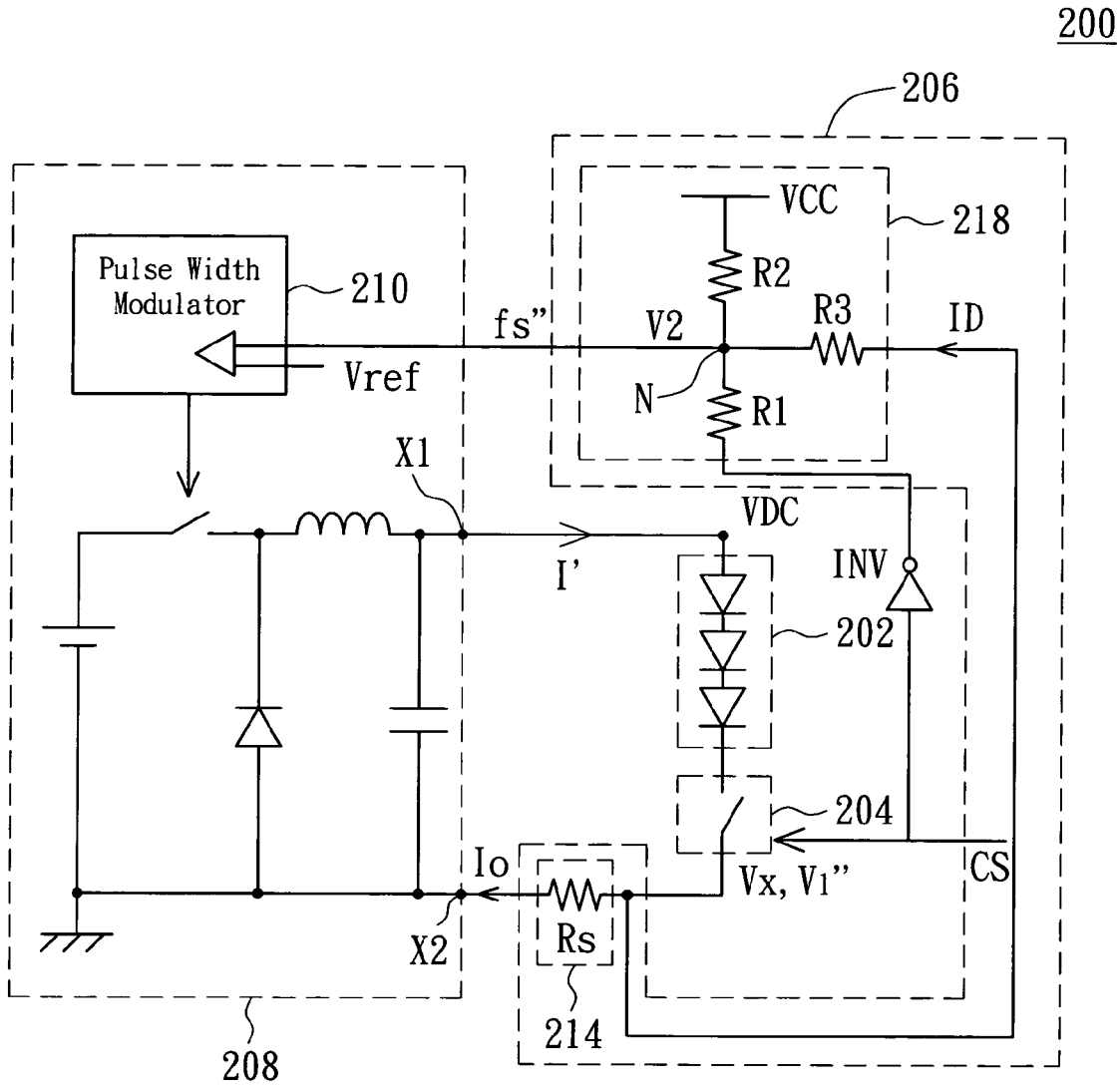
FIG. 10 shows a circuit diagram of a driving device for LED strings according to a fourth embodiment of the invention.

FIG. 10 shows a circuit diagram of a driving device for LED strings according to a fourth embodiment of the invention. The layout in this embodiment, as distinguishable from the third embodiment, is that a third impedance element R3 is connected to the second end of the first impedance element R1 and the first end of the second impedance element R2 at node N, and in place of the diode D of the voltage feedback circuit 218. Additionally, the control signal for switch 204 is connected to the first end of R1 through an inverter INV. The second end of R2 is connected to a fixed voltage, and is preferably at a non-zero voltage VCC. Like the above-mentioned embodiments, switch 204 is controlled by the control signal of switch 204, and is indicated on the figure as "CS". When the control signal CS is high, the switch 204 is turned on and the voltage level at the second end of R1 is equal to 0V since the control signal CS is inverted by inverter INV. The pulse width modulator 210 then controls DC-to-DC converter 208 to keep the voltage at node N to substantially approach the reference voltage Vref. By applying this embodiment, the voltage V1" required to be generated by the current-voltage converter 214 and fed back to the pulse width modulator 210 can be reduced, and the equivalent impedance of the current-voltage converter 214 can also be reduced, thereby effectively reducing energy dissipation. For instance, the fixed voltage at VCC is at 12V, and the reference voltage Vref is at 2.5V, and with an impedance ratio of R1:R2:R3 of 3:6:2, where R1, R2 and R3 are significantly greater than the equivalent impedance of current-voltage converter 214, i.e. impedance of Rs, then a feedback voltage V1" of only 1V is required to make the bias level at node N equal to Vref. When the control signal CS of switch 204 is low, the switch 204 is turned off and the voltage level at the second end of R1 is equal to VCC since the control signal CS is inverted by inverter INV. The feedback voltage V1" is at 0V due to the switch 204 being turned off. As a result, the voltage V2 at node N is now greater than Vref, such as V2=6V. The pulse width modulator 210 then controls the DC-to-DC converter 208 to stop generating power, in response to the voltage at node N being greater than Vref. The DC voltage VDC then is maintained by the output capacitor of the DC-to-DC converter 208, so that when the switch 204 is turned on again, the LED string 202 can be quickly lit up.

In addition, the DC-to-DC converter 208 under the four embodiments can also be replaced by a Buck converter, a Boost converter, a Buck-Boost converter, a Flyback converter, or a Full-Bridge converter to achieve the same effects in quickly lighting up and turning off LED string 202, and the use of the respective converters in the driving device for LED strings are shown in FIGS. 5–8.

The driving device for LED strings as mentioned above achieves the effects of quickly lighting up and turning off the LED strings. Also, the driving device for LED strings has the advantages of allowing the current flowing through the LED strings to remain stable while the LED strings are lit up, so that the LED string can maintain a constant light output despite different characteristics of LED strings, thus effectively reducing brightness variations across different LED strings.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A device for driving light emitting diodes, for applying in a backlight module of a liquid crystal display (LCD), the device comprising:

a DC-to-DC converter, having a first DC-to-DC converter end and a second DC-to-DC converter end, the second DC-to-DC converter end being coupled to a fixed voltage, the DC-to-DC converter outputting a DC voltage from the first DC-to-DC converter end according to a feedback signal;

a light emitting diode (LED) string coupled to the first DC-to-DC converter end;

a switch electrically connected to the LED string in series, for allowing the DC voltage to drive the LED string and allowing a DC current to flow through the LED string when the switch is turned on; and a feedback circuit for outputting the feedback signal according to the DC current, the feedback circuit comprising:

a current-voltage converter, having a first end and a second end, the first end of the current-voltage converter being coupled to the switch, the second end of the current-voltage converter being coupled to the second DC-to-DC converter end, the DC current flowing through the DC-to-DC converter when the switch is turned on, causing the current-voltage converter to generate a first reference voltage according to the DC current, the first reference voltage being used as the feedback signal;

whereby the LED string is lit up to reach a predetermined brightness level when the switch is turned on, and the LED string ceases illumination when the switch is turned off.

2. The device according to claim 1, wherein the LED string comprises an LED or a plurality of LEDs connected in senes.

3. The device according to claim 1, wherein the DC-to-DC converter comprises a pulse width modulator for adjusting an output signal of the pulse width modulator according to the feedback signal.

4. The device according to claim 3, wherein the first reference voltage is generated at the first end of the current-voltage converter and fed back to the pulse width modulator when the DC current flows through the current-voltage converter.

5. The device according to claim 4, wherein the current-voltage converter comprises a resistor.

6. The device according to claim 4, further comprising:

an amplifier, being connected to the first end of the current-voltage converter and the pulse width modulator, for amplifying the feedback signal and outputting the amplified feedback signal to the pulse width modulator.

7. The device according to claim 1, wherein the feedback circuit further comprises:

a voltage feedback circuit, when the switch is turned off, generating a second reference voltage to be used as the feedback signal according to the DC voltage.

8. The device according to claim 7, wherein the voltage feedback circuit comprises:

a first impedance element, having a first end and a second end, the first end of the first impedance element being coupled to the DC voltage, the second end of the first impedance element being coupled to a node, the node being coupled to the pulse width modulator; and a second impedance element, having a first end and a second end, the first end of the second impedance element being coupled to the node, the second end of the second impedance element being coupled to the fixed voltage, the voltage at the node being the second reference voltage;

wherein the second reference voltage being determined by the first reference voltage when the switch is turned on, the second reference voltage is used as the feedback signal by the feedback circuit;

wherein the second reference voltage being determined by the first and second impedance elements when the switch is turned off, wherein the second reference voltage is used as the feedback signal by the feedback circuit.

9. The device according to claim 8, wherein the voltage feedback circuit further comprises a diode, having a positive end and a negative end, the negative end of the diode being coupled to the node, the positive end of the diode being coupled to the first end of the current-voltage converter.

10. The device according to claim 8, wherein the voltage feedback circuit further comprises a third impedance element, having a first end and a second end, the first end of the third impedance element being coupled to the node, the second end of the third impedance element being coupled to the first end of the current-voltage converter.

11. The device according to claim 7, wherein the first reference voltage is generated while the DC current flows through the current-voltage converter, the first end of the current-voltage converter being coupled to the pulse width modulator via a diode.

12. The device according to claim 9, wherein the current-voltage converter comprises a resistor.

13. The device according to claim 9, further comprising:

an amplifier, being connected to the first end of the current-voltage converter and the positive end of the diode, for amplifying and outputting the feedback signal to the pulse width modulator.

14. The device according to claim 1, wherein the fixed voltage is ground.

15. The device according to claim 1, wherein the DC-to-DC converter is a Buck converter.

16. The device according to claim 1, wherein the DC-to-DC converter is a Boost converter.

17. The device according to claim 1, wherein the DC-to-DC converter is a Buck-Boost converter.

18. The device according to claim 1, wherein the DC-to-DC converter is a Full-Bridge converter.

19. The device according to claim 1, wherein the DC-to-DC converter is a Flyback converter.

20. The device according to claim 1, wherein the driving device for LED strings is for applying in a backlight module of a LCD.

21. The device according to claim 1, wherein the DC-to-DC converter comprises a comparator for adjusting an output signal of the comparator according to the feedback signal and a reference signal.

22. The device according to claim 21, wherein the first reference voltage is generated at the first end of the current-voltage converter and fed back to the comparator when the DC current flows through the current-voltage converter.

23. The device according to claim 22, wherein the current-voltage converter comprises a resistor.

24. The device according to claim 22, further comprising:

an amplifier, being connected to the first end of the current-voltage converter and the comparator, for amplifying the feedback signal and outputting the amplified feedback signal to the comparator.

25. A device for driving light emitting diodes, for applying in a backlight module of a liquid crystal display (LCD), the device comprising:

a DC-to-DC converter, having a first DC-to-DC converter end and a second DC-to-DC converter end, the second DC-to-DC converter end being coupled to a fixed voltage, the DC-to-DC converter outputting a DC voltage from the first DC-to-DC converter end according to a feedback signal, the DC-to-DC converter further comprising:

a pulse width modulator for adjusting an output signal of the pulse width modulator according to the feedback signal so that the DC-to-DC converter 208 outputs the DC voltage according to the output signal of the pulse width modulator;

a light emitting diode (LED) string coupled to the first DC-to-DC converter end;

a switch electrically connected to the LED string in series, for allowing the DC voltage to drive the LED string and allowing a DC current to flow through the LED string when the switch is turned on; and a feedback circuit for outputting the feedback signal according to the DC current;

whereby the LED string is lit up to reach a predetermined brightness level when the switch is turned on, and the LED string ceases illumination when the switch is turned off.

26. The device according to claim 25, wherein the feedback circuit comprises:

a current-voltage converter, having a first end and a second end, the first end of the current-voltage converter being coupled to the switch, the second end of the current-voltage converter being coupled to the second DC-to-DC converter end, wherein the DC current flows through the current-voltage converter when the switch is turned on, causing the current-voltage converter to generate a first reference voltage as the feedback signal, according to the DC current; and a voltage feedback circuit, when the switch is turned off, generating a second reference voltage to be used as the feedback signal according to the DC voltage.

27. The device according to claim 26, wherein the first reference voltage is generated while the DC current flows through the current-voltage converter, the first end of the current-voltage converter being coupled to the pulse width modulator via a diode.

28. The device according to claim 26, wherein the voltage feedback circuit comprises:

a first impedance element, having a first end and a second end, the first end of the first impedance element being coupled to the DC voltage, the second end of the first impedance element being coupled to a node, the node being coupled to the pulse width modulator; and a second impedance element, having a first end and a second end, the first end of the second impedance element being coupled to the node, the second end of the second impedance element being coupled to the fixed voltage, the voltage at the node being the second reference voltage;

wherein the second reference voltage being determined by the first reference voltage when the switch is turned on, the second reference voltage is used as the feedback signal by the feedback circuit;

wherein the second reference voltage being determined by the first and second impedance elements when the switch is turned off, wherein the second reference voltage is used as the feedback signal by the feedback circuit.

29. The device according to claim 28, wherein the voltage feedback circuit further comprises a third impedance element, having a first end and a second end, the first end of the third impedance element being coupled to the node, the second end of the third impedance element being coupled to the first end of the current-voltage converter.

30. The device according to claim 28, wherein the voltage feedback circuit further comprises a diode, having a positive end and a negative end, the negative end of the diode being coupled to the node, the positive end of the diode being coupled to the first end of the current-voltage converter.

31. The device according to claim 30, wherein the current-voltage converter comprises a resistor.

32. The device according to claim 30, further comprising:

an amplifier, being connected to the first end of the current-voltage converter and the positive end of the diode, for amplifying and outputting the feedback signal to the pulse width modulator.

33. The device according to claim 25, wherein the fixed voltage is ground.

34. The device according to claim 25, wherein the DC-to-DC converter further comprises a Buck converter.

35. The device according to claim 25, wherein the DC-to-DC converter further comprises a Boost converter.

36. The device according to claim 25, wherein the DC-to-DC converter further comprises a Buck-Boost converter.

37. The device according to claim 25, wherein the DC-to-DC converter further comprises a Full-Bridge converter.

38. The device according to claim 25, wherein the DC-to-DC converter further comprises a Flyback converter.

39. The device according to claim 25, wherein the driving device for LED strings is for applying in a backlight module of a LCD.

40. The device according to claim 25, wherein the pulse width modulator adjusts the output signal of the pulse width modulator according to the feedback signal and a reference signal.

41. The device according to claim 40, wherein the pulse width modulator comprises a comparator for comparing the output signal of the pulse width modulator according to the feedback signal and a reference signal.

* * * * *